United States Patent [19]

Mansfield

[11] Patent Number: 4,696,451

[45] Date of Patent: Sep. 29, 1987

[54] GRID SYSTEM AND METHOD FOR CAST FORMING MONOLITHIC CONCRETE ROOF COVERING

[76] Inventor: Peter W. Mansfield, 511 59th St., Holmes Beach, Fla. 33510

[21] Appl. No.: 934,946

[22] Filed: Nov. 24, 1986

Related U.S. Application Data

[63] Continuation-in-part of Ser. No. 749,391, Jun. 27, 1985, Pat. No. 4,624,082.

[51] Int. Cl.[4] ..... E04G 9/08; E04G 9/10; E04B 7/02

[52] U.S. Cl. ..... 249/16; 52/125.3; 52/127.3; 52/748; 52/749; 249/15

[58] Field of Search ..... 249/15, 16; 52/91, 96, 52/122.1, 125.3, 127.3, 748, 749

[56] References Cited

U.S. PATENT DOCUMENTS

| | | | |
|---|---|---|---|
| Re. 24,425 | 2/1958 | Thomas | 249/16 X |
| 430,370 | 6/1890 | Babcock | 52/57 |
| 552,787 | 1/1896 | Smith | 52/396 |
| 639,961 | 12/1899 | De Man | 52/396 |
| 974,002 | 10/1910 | Walton | 249/16 |
| 1,020,586 | 3/1912 | Walton | 249/16 |
| 1,075,403 | 10/1913 | Cole | 249/16 |
| 1,274,987 | 8/1918 | Carroll | 52/91 X |
| 2,029,817 | 2/1936 | Fegles | 52/396 X |
| 2,193,233 | 3/1940 | Hardy | 52/416 X |
| 2,198,685 | 4/1940 | Wallace | 264/33 |
| 2,379,051 | 6/1945 | Wallace | 52/748 X |
| 2,543,939 | 3/1951 | Rumble | 52/418 X |
| 2,748,443 | 6/1956 | Dufford | 52/314 |
| 3,222,436 | 12/1965 | Woodworth | 264/35 |
| 3,382,637 | 5/1968 | Longinotti | 52/309.12 X |
| 4,624,082 | 11/1986 | Mansfield | 52/91 X |

FOREIGN PATENT DOCUMENTS

| | | | |
|---|---|---|---|
| 264171 | 4/1929 | Italy | 52/96 |

*Primary Examiner*—Alfred C. Perham
*Attorney, Agent, or Firm*—Charles J. Prescott

[57] ABSTRACT

A reusable grid system and method for in place cast forming a monolithic roof covering for a sloped roof, the roof covering having the stepped and segmented appearance of a tiled roof. The grid system includes a plurality of horizontally disposed dam bars and transversly disposed fixed and movable spacer bars therebetween which, when removably assembled atop a sloped roof, are adapted to retain monolithic poured and scraped plastic uncured concrete or the like so as to have an exposed surface which substantially duplicates a conventional tile roof after curing and removal of the grid system. The cured roof covering is thus monolithic from one eave to peak to the other eave and may include foam-filled cavities for thermal insulation and weight reduction, longitudinal segmented elastomer-filled expansion joints, formed eaves with gutter connecting means and molded edges. The grid system may also include a movable spacer bar assembly, as well as means for forming the valley between two adjacent roof sections.

12 Claims, 26 Drawing Figures

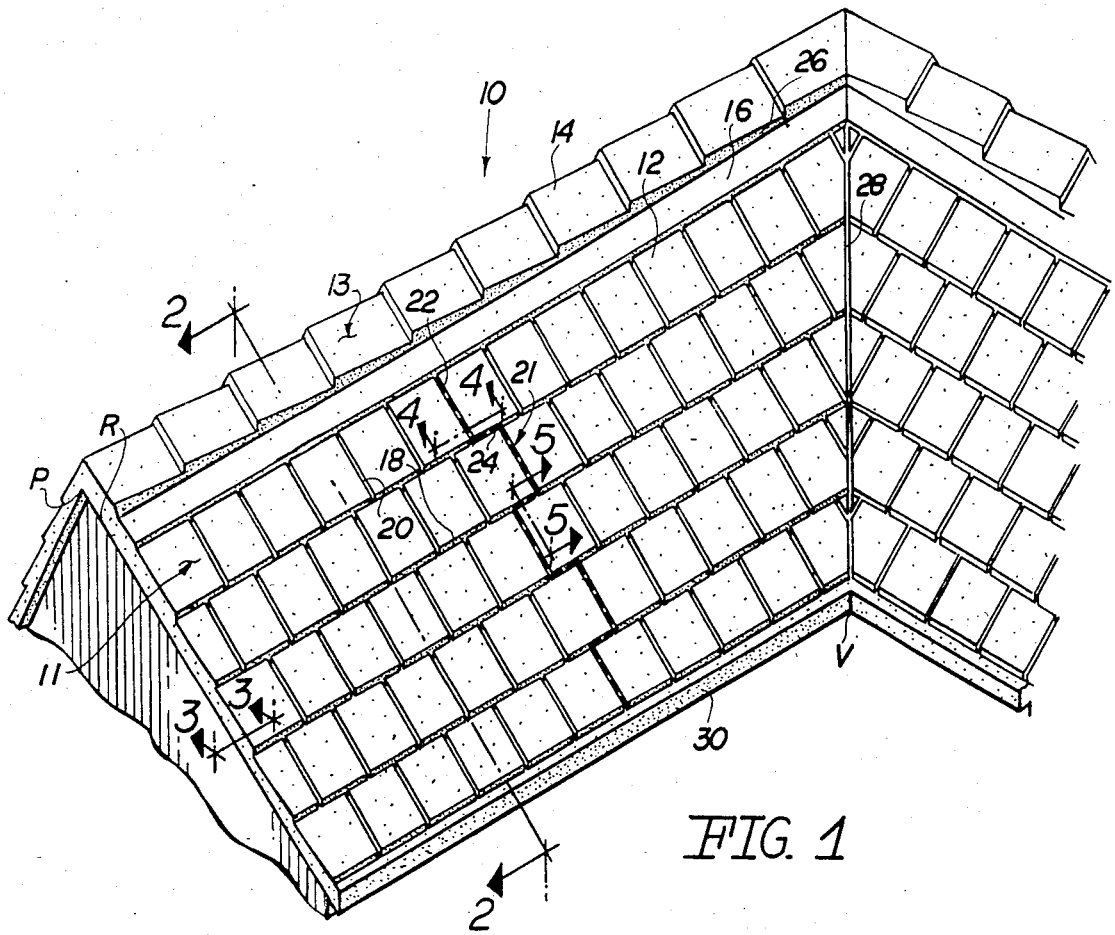
FIG. 1
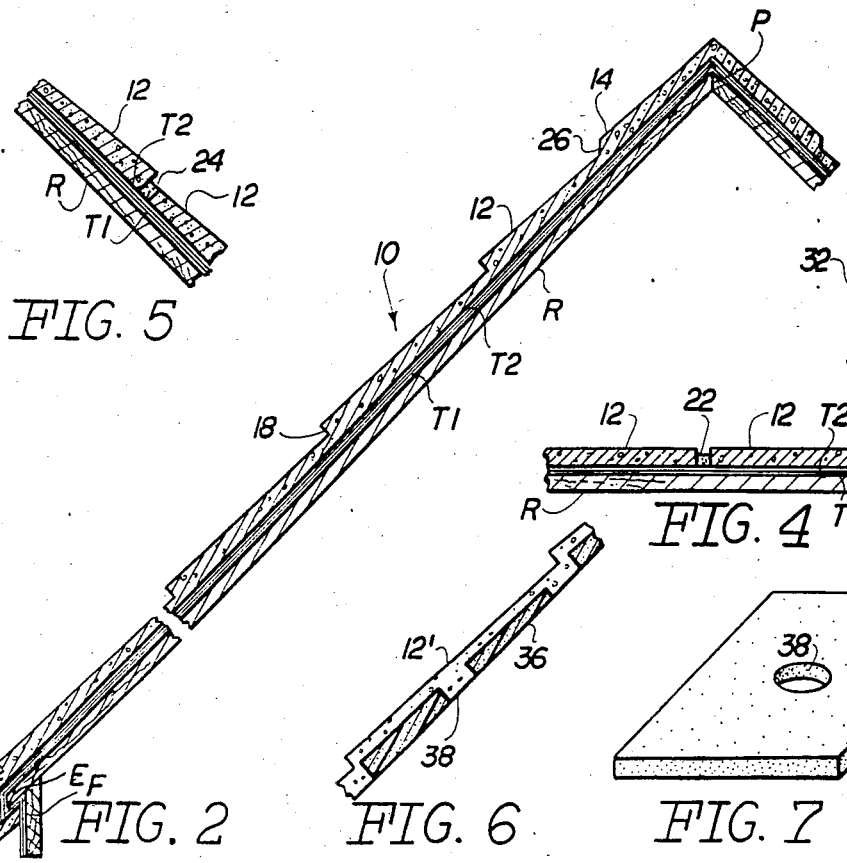
FIG. 2
FIG. 5
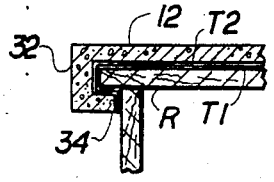
FIG. 3
FIG. 4
FIG. 6
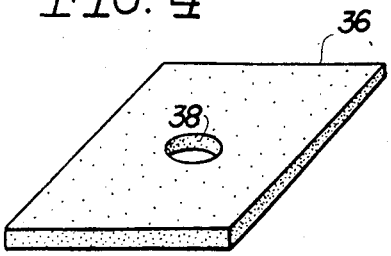
FIG. 7

128
104
110
100
102
106
112
108
129
114
116
114
118
114

124
126
114
120
122

42
140
42
142
T2

130
42
42
132
134
T2
136

150
152
154
156
158
26
26

144
148
149
146
147
151
42
42
150'

94
42
154
T2
152
162
T1
R
156
150
164
158

GRID SYSTEM AND METHOD FOR CAST FORMING MONOLITHIC CONCRETE ROOF COVERING

This is a continuation-in-part application of Ser. No. 06/749,391, filed Jun. 27, 1985, now U.S. Pat. No. 4,624,082. This invention relates generally to building roof coverings and more particularly to a poured monolithic concrete or other like pourable, hardenable material atop a sloped roof.

In the past, as an alternative to well-known tar shingled roofing, various coverings have been devised to provide roof protection which outlives and better protects underlying building roofs. Well-known clay tile roofing does provide longer useful service and also provides a unique aesthetic appearance. However, clay tiles are expensive, fragile and expensive to install.

A process for molding a roof slab of concrete or other plastic material is disclosed in U.S. Pat. No. 2,543,939 to Rumble. However, the process requires erection of support structure and produces a heavy, flat slab typical of commercial structures. In U.S. Pat. No. 2,193,233 to Hardy, another method is disclosed for producing a roof covering of thin individually cast labor-intensive mortar or concrete shingles which appear likened to individual roof tiles. Still other prior art in U.S. Pat. No. 2,379,051 to Wallace discloses a sectioned self-hardening plastic formed roof covering and method which includes a unique means for insuring that trapped moisture thereunder exists to the exposed surface. This feature mandates horizontal separated sections which are poured in place aided by simple individual rails and labor intensive techniques.

The present invention discloses a reusable grid system and method for cast forming a monolithic concrete or the like roof covering which has the finished appearance of tile roofing but which is continuous from peak to eave and which reduces installation cost and time over previous methods.

BRIEF SUMMARY OF THE INVENTION

The present invention is for a reusable grid system and method for in place cast forming a monolithic roof covering for a sloped roof, the roof covering having the stepped and segmented appearance of a tiled roof. The grid system includes a plurality of horizontally disposed dam bars and transversly disposed fixed and movable spacer bars therebetween which, when removably assembled atop a sloped roof, are adapted to retain monolithic poured and scraped plastic uncured concrete or the like so as to have an exposed surface which substantially duplicates a conventional tile roof after curing and removal of the grid system. The cured roof covering is thus monolithic from one eave to peak to the other eave and may include foam-filled cavities for thermal insulation and weight reduction, longitudinal segmented elastomer-filled expansion joints, formed eaves with gutter connecting means and molded edges. The grid system may also include a movable spacer bar assembly, as well as means for forming the valley between two adjacent roof sections.

It is therefore an object of this invention to provide a reusable grid system and method for in-place cast forming a continuous concrete or the like monolithic roof covering having the exposed appearance of conventional individual clay, concrete, or ceramic stepped tile.

It is another object of this invention to provide a monolithic concrete or the like roof covering which is economical to cast form in place atop a sloped roof.

It is still another object of this invention to provide the above roof covering having favorable weight reduction features and integral finished roof edge-and-eave encapsulating contours and embedded gutter fasteners for use.

In accordance with these and other objects which will become apparent hereinafter, the instant invention will now be described with reference to the accompanying drawings in which:

BRIEF DESCRIPTION OF THE DRAWINGS

FIG. 1 is a perspective view of the monolithic roof covering according to the present invention.

FIG. 2 is a section view in the direction of arrows 2—2 in FIG. 1.

FIG. 3 is a section view in the direction of arrows 3—3 in FIG. 1.

FIG. 4 is a section view in the direction of arrows 4—4 in FIG. 1.

FIG. 5 is a section view in the direction of arrows 5—5 in FIG. 1.

FIG. 6 is a portion of a section view similar to FIG. 2 of an alternate embodiment of the roof covering.

FIG. 7 is a perspective view of an insulating and weight reducing plate which may be embedded in the roof covering during cast forming.

DETAILED DESCRIPTION OF THE INVENTION

Figures 8, 9, 10, 11, 12:
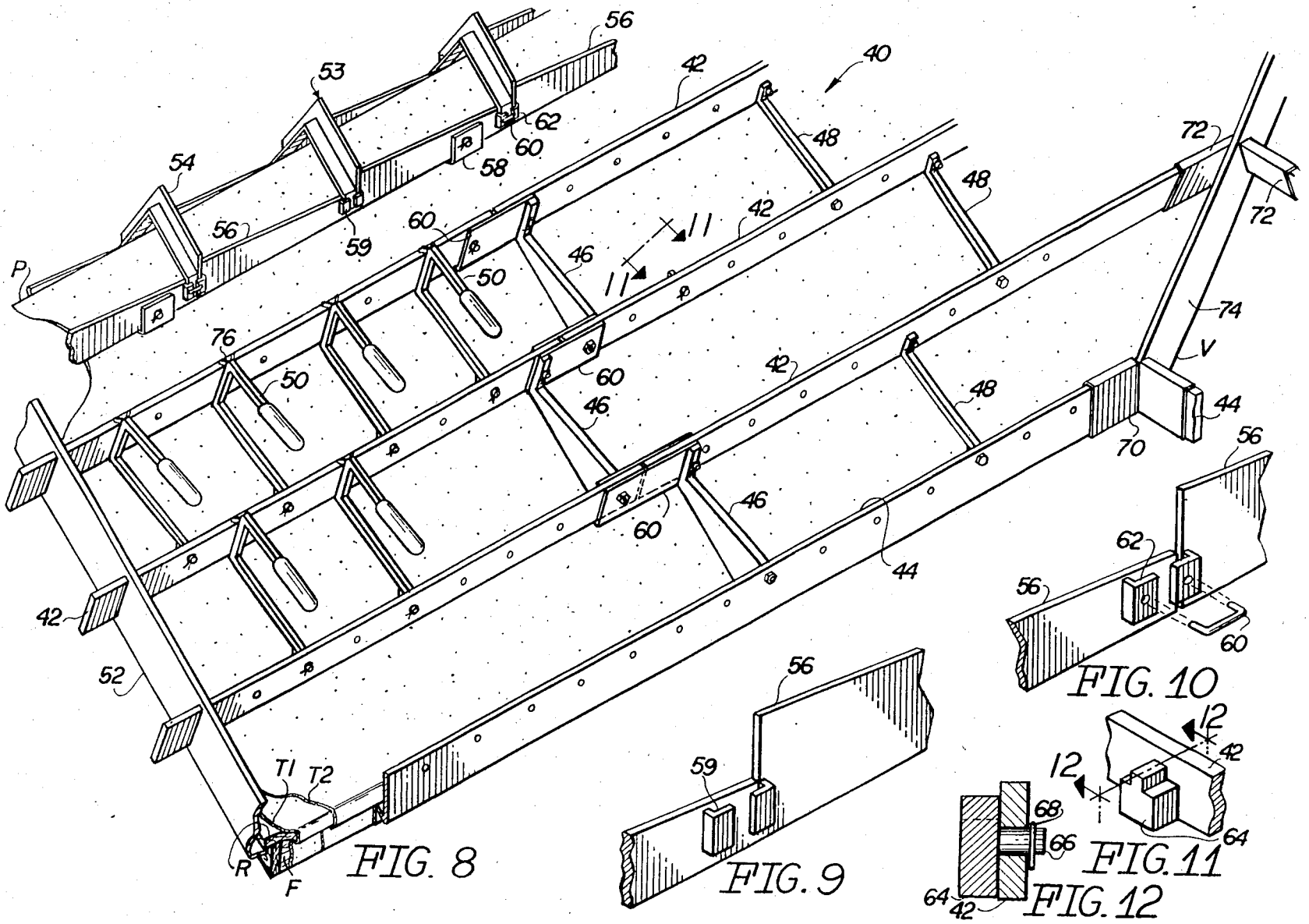
FIG. 8 is a perspective view of the grid system of the present invention.
FIG. 9 is a perspective view of the angle peak bar retention bracket.
FIG. 10 is a perspective view of the connection between side bar segments of the peak grid.
FIG. 11 is a perspective view of one embodiment of the lower end movable spacer support means in the direction of arrows 11—11 in FIG. 8.
FIG. 12 is a section view in the direction of arrows 12—12 in FIG. 11.

Referring now to the drawings, and particularly to FIGS. 1 through 5, the roof covering of the present invention is shown generally by the numeral 10 poured or cast formed in place atop the roof R of pourable, hardenable material such as concrete or the like. The roof covering 10 includes a plurality of rows 11 of panel portions 12, each adjacent panel portion 12 separated and defined by a recess line 20, each row 11 of panel portions 12 defined by a horizontal row edge 18. The recess lines 20 penetrate into the top or exposed surface of each row but do not go to the roof or tarpaper T1 and T2 which may be therebetween. These recess lines 20 are disposed transversly to each row 11 in alignment with the slope of the roof R. Each horizontal row edge 18 runs from one roof edge to the other or to a valley V formed by the intersection of two adjacent roof portions. The plane of each horizontal row edge 18 is disposed generally perpendicular to the roof R at that particular line across the roof R, but does not go down to the roof R or tarpaper T1 and, preferrably tarpaper T2. For simplicity, the roof covering 10 of this invention is disposed will be generally referred to as the "subsurface".

Spanning and covering the subsurface peak P of the roof R is a roof peak cover 13 defined by a plurality of adjacent peak step portions 14 and parallel peak cover edge planes 26 disposed on either side of the peak P. Each peak cover edge plane 26 is generally perpendicular to ground as shown, but does not extend to the subsurface tar paper T2.

Disposed between the roof peak cover 13 and the uppermost row 11 having defined panel portions 12 is variable width row 16, absent any recesses 20. The purpose for this variablility in width is to accommodate virtually any roof slope length so as to maintain a predetermined uniform length of each recess 20.

As best seen in FIG. 2, two layers of moisture barrier tarpaper T1 and T2 are typically used in the industry to insure a complete barrier to the wood roof R by any moisture from above. The concrete roof covering 10 is then in-place formed atop the subsurface tar paper T2, rather than the bare wood. The tar paper T1 and T2 are strongly adhered to the roof R by well known means while the pourable precured concrete also strongly adheres to the upper layer of tarpaper T2 as it hardens.

Each row 11, as well as the entire roof cover 10 has edge boundaries defined either by a valley recess 28 or by edge portions 32 and 34 which encapsulate the roof edge as shown in FIG. 3. Two layers of tarpaper T1 and T2 first surround the exposed wood of the roof R, then concrete edge portions 32 and 34 encapsulate both the tarpaper T1 and T2 for both protection and finished appearance.

Similarly, as seen in FIG. 2, the eave E, along with a portion of the facia board F are first wrapped with tarpaper layers T1 and T2, then the eave portion 30 encapsulates the entire eave E as shown to provide maximum protection and a finished appearance.

As may now be better understood, the roof covering 10 is truly monolithic or continuous in section from roof eave-to-eave and from roof edge-to-edge while still having the exposed stepped, and segmented top surface of a conventional tile roof. The various concrete portions, while varying in thickness to achieve the exposed stepped surface, nonetheless are uninterrupted even over the peak P of the roof R.

One planned optional and preferred exception to this continuity of roof covering 10 is a thermal expansion joint 21 running in zig-zag fashion along substantially the entire slope of the roof R. This expansion joint 21 is formed by segments 24 of each row edge 18 and predetermined recesses 22, all of which are connected. The expansion joint 21 is filled with an elastomeric material so as to completely transect the roof covering 10 down to the subsurface tarpaper T2. Although not shown, this expansion joint may also transect the roof peak cover 13 and the variable width rows 16.

Referring now to FIGS. 8 to 12, the grid system for cast forming the previously described roof covering 10 is shown generally at 40. This grid system 40 includes a plurality of parallel spaced-apart elongated rigid dam bars 42 disposed horizontally across the roof and a plurality of elongated rigid spacer bars 46, 48 and 50 transversly disposed and supportively connectable to the dam bars 42. Each dam bar 42 is placed edgewise spaced above the subsurface tarpaper T2, such as to be generally perpendicular to the slope of the roof R as shown. These dam bars 42 are held displaced above and apart from the roof R by expansion joint dam bar splice 61 which may also serve to splice the ends of two adjacent dam bars 42 together. The flow gap formed between the bottom edge of each dam bar 42 and the subsurface tarpaper T2 facilitates concrete flow therebetween during pouring.

Two styles of fixed spacer bars 46 and 48 are releasably connectable to the dam bars 42 by conventional threaded fasteners so as to both properly space and align the dam bars 42 and also to securely retain them in the position shown during the pouring process. Note that while support spacer bars 48 are disposed above the subsurface tarpaper T2, expansion spacer bars 46 extend down to, and contact, the subsurface tarpaper T2 and to support the dam bars 42 and support spacer bars 48.

A third movable spacer bar 50 is removable or placeable between any two dam bars 42 as shown after the dam bars 42 and expansion and support spacer bars 46 and 48 have been bolted into position. Like the support spacer bar 48, the movable spacer bar 50, when in position, is disposed above the subsurface tarpaper T2 so as to form a recess 20. These movable spacer bars 50 may include handles and are made releasably positionable at their upper end by support fingers 76 resting upon the top edge of a dam bar 42 and at their lower end by mateable engagement to support block 64 as best seen in FIGS. 11 and 12. These support blocks 64 are held in positon by snap pins 68 into their shaft portions 66 as shown.

To form the previously described roof covering encapsulating edges 32 and 34, an edge form 52 having apertures therethrough is adapted to align and slide over the ends of the dam bars 42 and abutt against the edge of the roof. Having a generally "L" cross section facilitates retention of the pourable concrete so as to accomplish the previously described roof edge encapsulation while the concrete cures.

To form the previously described stepped peak cover 13, a peak grid 53 is also included in the preferred embodiment of the grid system 40 and includes a pair of elongated side bars 56 placeable in spaced apart fashion horizontally atop the subsurface, tarpaper T2 and parallel to the peak P. Also included are a pluralilty of angle peak bars 54 which are releasably interconnectable transversely between the side bars 56 by "L" brackets 55 and 62 in FIGS. 9 and 10. These angle peak bars 54, generally matching the roof peak angle, span and are displaced above the subsurface at peak P so as to form a flow slot therebetween. The side bars 56 are also held above and displaced from the subsurface tarpaper T2 to form flow slots therebetween by riser blocks 58. The angle peak bars 54 as best seen in FIG. 9, supportively engage into mating "L" brackets 55 connected to the lower side of the side bars 56. Where the side bars 56 are spliced as shown in FIG. 10, these modified "L" brackets 62 also include apertures to receive a clip 61 for retaining the side bars 56 in aligned abuttment one to another as shown.

Where a finished and encapsulating roof cover eave 30, as previously described, is desired, an eave form 44 may also be included in the grid system 40. This eave form 44, elongated, rigid and having a generally "Z" cross-section, is clampable to the facia board F and so held during pouring of the concrete. With the tarpaper T1 and T2 wrapped and in place, clamped beneath the eave form 44, the eave incapsulating section 30, described and shown in FIG. 2 is accomplished.

To form the roof covering valley recess 28, a valley bar 74 is also provided which is placed edgewise in alignment with, and atop, the subsurface of the roof at valley V. The valley bar 74 is so held during concrete pouring by cornerplate 70, which telescopes over the adjacent eave forms 44, and by collars 72, which resistively telescope over the dam bars 42 to opposingly press against the sides of the valley bar 74.

Figure 13:
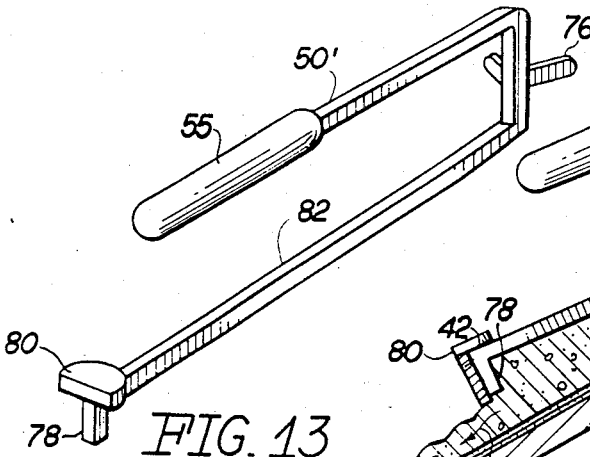
FIG. 13 is a perspective view of a second embodiment of the movable spacer bar.
Figure 14:
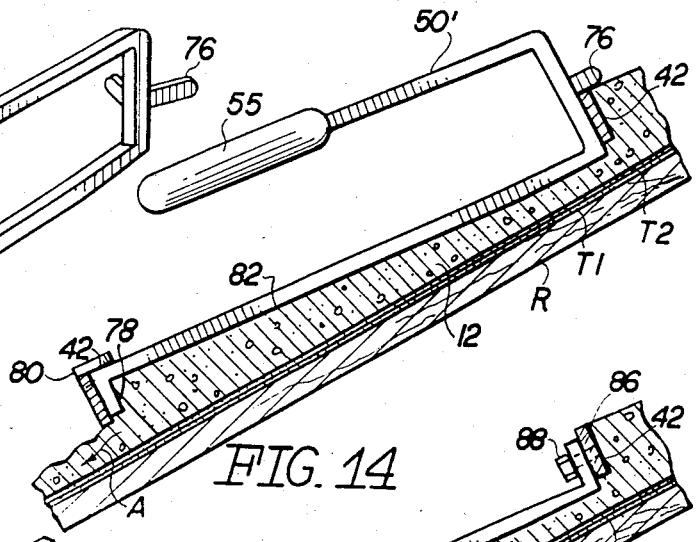
FIG. 14 is an elevation section view of the movable spacer bar of FIG. 13 in use.

Referring now to FIGS. 13 and 14, another embodiment of the moveable spacer bars is shown at 50' and includes at one end support fingers 76 which supportively rest on the top edge of a dam bar 42. At the other end of the movable spacer bar 50' is a support tab 80 and an end form bar 78. The support tab 80 supportively rests atop the edge of the next lower dam bar 42 as shown. The recess 20 between and defining each panel portion 12 is thus formed by the recess bar portion 82 and the end form bar 78. The handle portion 55 allows quick and positive installation and removal of these movable spacer bars 50 and 50' without interferring with the poured concrete scraping or trowelling process described more fully below.

Figure 15:
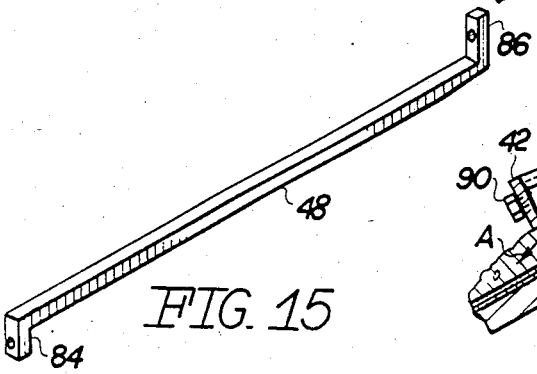
FIG. 15 is a perspective view of the fixed spacer bar.
Figure 16:
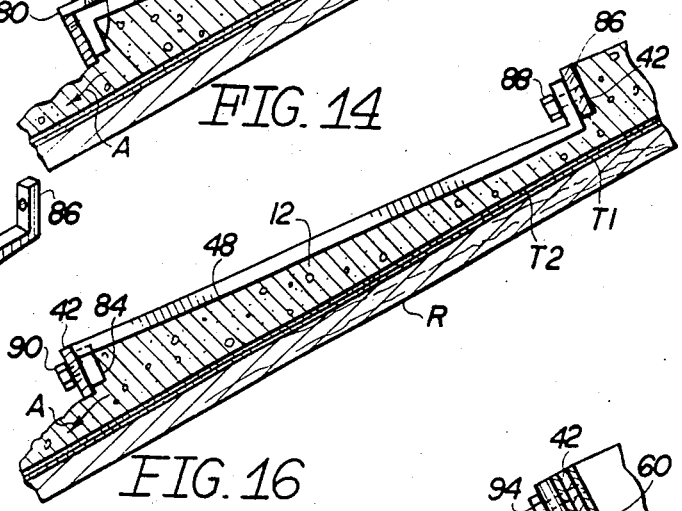
FIG. 16 is an elevation section view of the support spacer bar of FIG. 15 in use.

The support spacer bar 48 is shown more fully in FIGS. 15 and 16 and includes a rigid elongated straight center portion and opposing tabs 84 and 86 at each end for secure, supportive installation between the dam bars 42. Threaded bolts 88 and 90 secure the support spacer bars in position against and between the dam bars 42.

Figure 17:
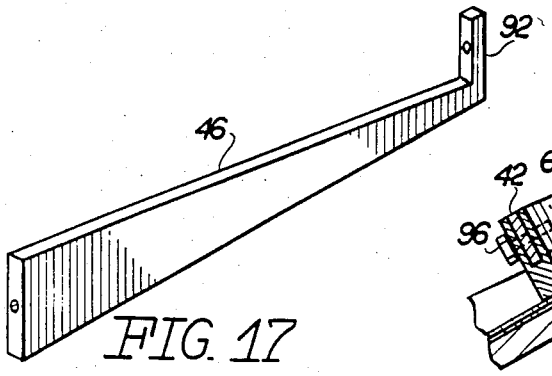
FIG. 17 is a perspective view of the expansion spacer bar.
Figure 18:
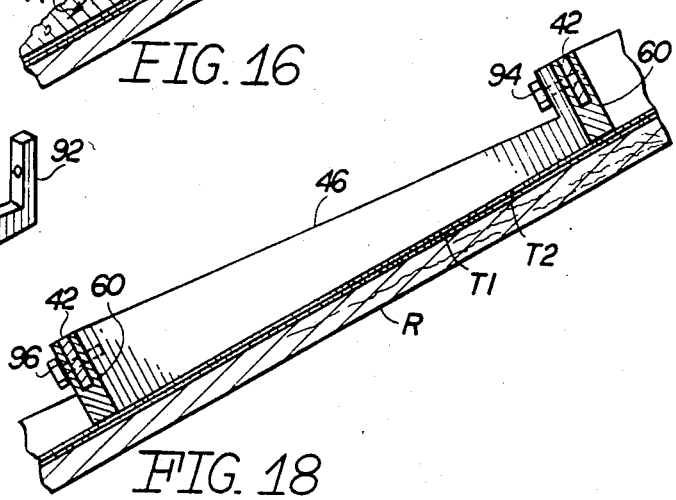
FIG. 18 is an elevation section view of the expansion spacer bar of FIG. 17 in use.

In FIGS. 17 and 18 is shown the expansion spacer bar 46 which is held in position between the dam bars 42 by threaded fasteners 94 and 96. The expansion spacer bar 46 extends downward to the subsurface, tarpaper T2, as does the expansion joint dam bar splice 61, both of which cooperate to form the groove for the elastomer-filled expansion joint 21 previously described.

Figure 19:
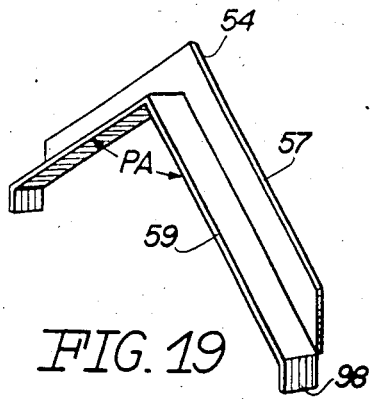
FIG. 19 is a perspective view of the angle peak bar.
Figure 20:
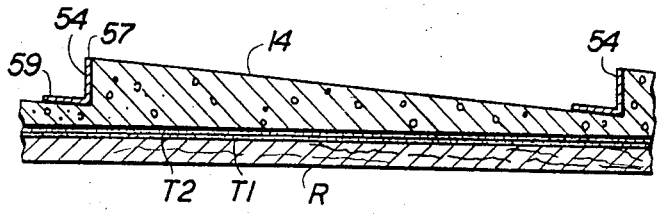
FIG. 20 is an elevation section view of the angle peak bar of FIG. 19 in use.

The angle peak bar 54 is shown in detail in FIGS. 19 and 20 and includes adjacent angle section portions which combine to form a peak angle PA which substantially matches that of the roof peak or may also be chosen to be unequal to that of the roof peak to produce other desired appearances in the peak step portion 14. Tabs 98 supportively engage into "L" brackets 59 or 62 as previously described.

Figure 21:
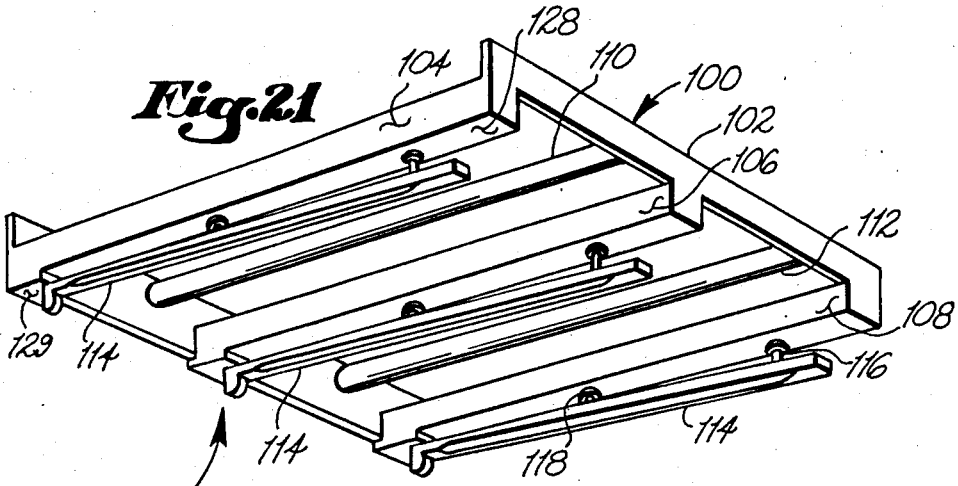
FIG. 21 is a perspective view of the bottom of a recess printer assembly showing an exploded enlarged view of one of the marker elements connected thereto.

Referring now to FIG. 21, a recess printer assembly is shown generally at numeral 100 and includes a plurality of recess bars 114 connected by mounting posts 116 and 118 to the cross members 104, 106 and 108 of rectangular frame 102. The recess printer assembly 100 also includes handle bars 110 which allow the recess printer assembly 100 to be repeatedly manipulated into the poured and partially cured concrete material. Referring to FIG. 14 for reference to understand the position into which the recess printer assembly 100 is repeatedly placed, the bottom surface of the cross members 104 at numeral 128 contacts and is supported by the top edge of an upper dam bar 42 while the bottom surface of the cross bar at numeral 129 contacts the top edge of the next adjacent lower dam bar 42. End surface 120 of each recess bar 114 contacts against the lower surface of the upper dam bar 42 while end surface 124 contacts the upper surface of the next adjacent lower dam bar 42 similar to the end form bar 78 in FIG. 14. The lower edge 122 of each recess bar 114 is tapered to facilitate the use of this recess printer assembly 100 in conjunction with partially cured concrete and also wherein the assembly 100 will be left in place embedded in the concrete as described for a short period of time during continued curing of the concrete, thus facilitating easy removal of the recess bars 114 therefrom. By this means, then, a user may quickly move along the concrete which has been poured in place and is curing to imprint recess lines 20 in each row 12 of the monolithic roof 10 as it is poured and scraped flat as previously described.

Figure 22:
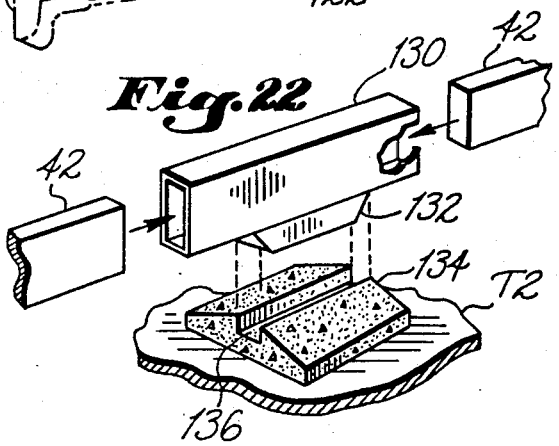
FIG. 22 is a perspective view of a dam bar support insert and dam bar splice.

Referring now to FIG. 22, an alternate embodiment of the dam bar splice 130 is shown having a tubular construction and having a rigid bar 132 disposed along one edge and concrete dam bar support insert 134. The insert 134 is shaped to have a central longitudinal groove 136 which is adapted to receive the bar 132 attached to dam bar splice 130. The insert 134 is fabricated of concrete and is intended to be bonded to the subsurface tar paper T2 as the grid system is assembled in its proper position for pouring. The insert 134 is fabricated preferrably of concrete to become an integral part of the monolithic roof 10. Dam bars 42 slip into the tubular splice 130 in the direction of the arrows.

Figure 23:
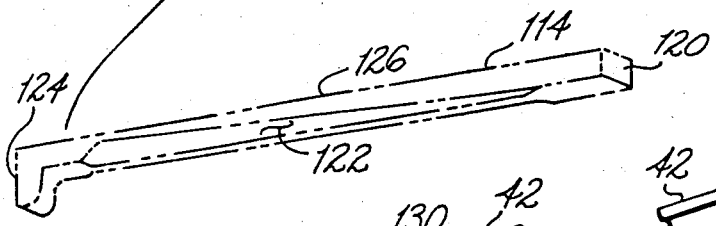
FIG. 23 is a perspective broken view of another embodiment of the expansion joint/dam bar splice.
Figure 23:
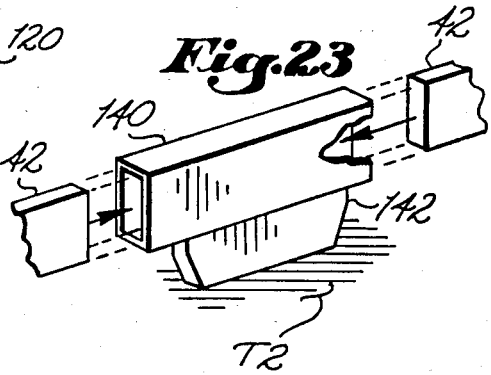

Referring now to FIG. 23, an alternate dam bar splice 140 is shown having a bar 142 disposed from its lower edge which is enlarged and intended to penetrate all the way to the subsurface T2. The dam bars 42 slip into place within the tubular splice 140 in the direction of the arrows as shown. This embodiment of the splice 140 is intended to form the segment 24 of the expansion joint 21 as previously described.

Figure 24:
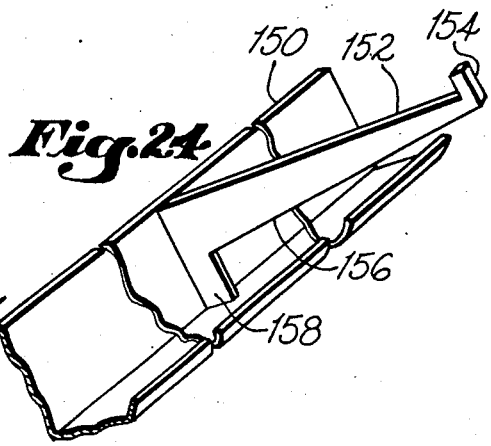
FIG. 24 is a perspective view of another embodiment of the eave form.
Figure 26:
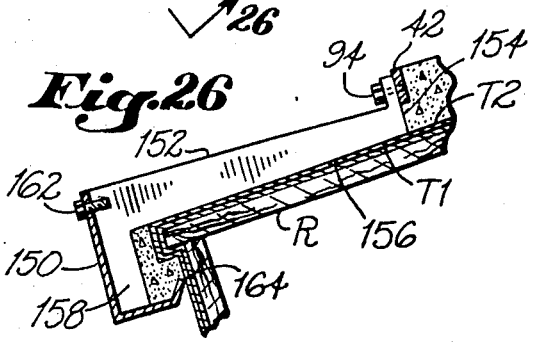
FIG. 26 is a section view in the direction of arrows 26—26 in FIG. 24.

Referring now to FIGS. 24 and 26, an alternate and preferred embodiment of the eave form 150 is shown formed of a single rigid sheet and having perpendicularly disposed sides and an upturned edge so as to press against the subsurface of the tar paper T2 at 164. The eave form 150 is adapted to mate against and be held in place by bolt 162 to modified expansion joint spacer bar 152, which has been modified by adding portion 158 thereto matable to the inside contour of the eave form 150. The eave form 150 receives support from the modified expansion joint spacer bar 152 which is in turn bolted to dam bar 42 as previously described and is supported atop the subsurface tar paper T2 and roof R thereunder.

Figure 25:
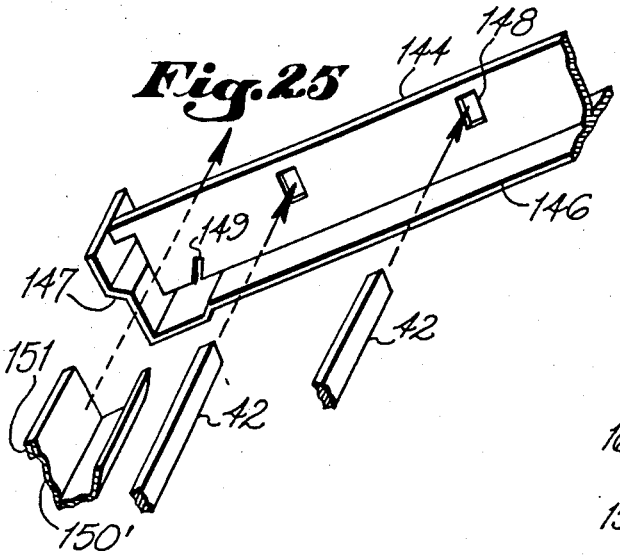
FIG. 25 is an exploded perspective view of another embodiment of the edge form and mating eave form.

Referring lastly to FIG. 25, an alternate and preferred embodiment of the edge form bar 144 includes panel 146 which laterally extends in both directions from the central upright panel which includes apertures 148 configured to receive dam bars 42 passed therethrough.

The inverted "T" configuration of this edge form bar 144 is intended to render same ambidextrous, thus usable at either right or left edge of the roof R. The lower folded end configuration 147 of panel 146, along with slot 149, is adapted to slideably receive eave form 150' which has been modified to include strengthening fold 151 at its upper margin as shown.

Both of the contoured eave form bars 150 and 150' have similar cross sections and are adapted to telescopically slideably engage one to another to provide the precise length required for a particular installation.

METHOD OF CONSTRUCTION

A roof covering 10 formed of pourable, hardenable material such as concrete is formed in place atop the subsurface of a roof R by first, if desired, spreading and attaching a layer of bituminous felt T1 over the entire roof R, followed by a layer of mineral roofing T2, both previously referred to for simplicity as tarpaper. Dam bars 42 are then laid atop the subsurface, tarpaper T2 in spaced parallel fashion horizontally or transverse to the slope of the roof R. Support spacer bars 48 are then placed transversly to and between the dam bars 42 and fastened in place. After determining the path of any thermal expansion joint(s), the appropriate expansion spacer bars 46 along with expansion joint splice blocks 61 are fastened in place, also positioned transversly to and between the dam bars 42. The dam bars 42 are now displaced and held above the subsurface, tarpaper T2 a certain distance referred to as a flow slot, supported thusly by the expansion joint splice bars 61.

The peak grid 53 is then assembled over the subsurface at peak P by interconnecting side bars 56 and angle peak bars 54 so as to evenly span the peak P. Riser blocks 58 support the side bars 56 above the subsurface to form a flow slot therebetween. Where desired, the eave form 44 and edge form 52 may also be here installed. Note that the edge form 52 may also be reversed and abutted against the edge of the roof R to eliminate any encapsulation there. Where there is a roof valley V, a valley bar 74 may be here installed along with telescoping collars 72 and corner plate 70. The grid system 40 is now in ready position for pouring the concrete therein.

The preferred concrete pouring sequence begins at the peak P, where concrete is poured between the side rails 56. A small amount of concrete is forced under each angle peak bar 54 and through the flow slot between the bottom edge of the side bars 56 and the subsurface. When sufficient concrete has been poured or pumped into the peak grid 53, excess concrete is scraped or screened away down to the planes defined by the top edge of each step of a side bar 56, the top edge of one side of the upright web 57 of one angle peak bar 54 and the bottom surface of the near horizontal web 55 of the adjacent angle peak bar 54.

After the variable width row 16 has been poured and scraped on either side of the now poured peak cover 13, more concrete is then poured down to and under the next adjacent dam bar 42 in the direction of arrows A in FIGS. 14 and 16. Scraping the excess concrete is done down to the top edge of the lower dam bar 42, and the top edge of the support and expansion spacer bars 48 and 46. This thusly defined plane of each row 11 is coplaner with the bottom edge of the adjacent upper dam bar 42. Immediately after scraping a particular row 11, the movable spacer bars 50 or 50'' or recess bar assembly 100 are embedded into the wet concrete and seated into position between the adjacent dam bars 42 such that the top surface of each movable spacer bar 50 or 50' or recess bar 114 is also coplaner with this struck off concrete planer surface and forms the remainder of the recesses 20.

Pouring and scraping the concrete continues down the side of the roof to the eave and eave form 44. Accomplishing the encapsulation of both roof eave E and edge by concrete should now be well understood.

Where sufficient support manpower is unavailable, one side of the roof subsurface may be poured over at a time. However, it is then preferred that the first poured side begin at the uppermost row having recesses 20 and expansion joints 22. The peak cover 13 and unrecessed variable width rows 16 are then accomplished at the beginning of pouring the other side of the roof before proceeding downward with pouring and scraping the second side.

Removal of both movable spacer bars 50 or 50', or recess bar assembly 100 should be accomplished before the concrete is fully cured and hard so as to aid in this removal process. These spacer bars 50 or 50' or recess bar assembly 100 may then be used on the lower poured sections or stored for reuse. Note again that the tapered lower edge 122 of the recess bars 114 facilitates their removal.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A reusable grid system for cast forming a monolithic roof covering of concrete or other like pourable, curable material atop a sloped roof, the cured, hardened monolithic roof covering having an exposed upper finished surface having the appearance of a conventional tile roof, said grid system comprising:

a plurality of elongated rigid dam bars each generally straight and having opposing top and bottom edges and opposing upper and lower sides;

a plurality of elongated rigid spacer bars each having opposing upper and lower ends and opposing top and bottom edges;

said spacer bars adapted to be releasably positioned atop, and generally aligned with the slope of, the roof in spaced apart stabilizing fashion transversly between each two adjacent, generally parallel said dam bars when said dam bars are disposed in spaced part generally parallel and horizontal fashion atop the roof such that each said spacer bar upper end is against said lower side of one said dam bar and pointing up the slope of the roof and such that each said spacer bar lower end is against said upper side of another said dam bar and pointing down the slope of the roof;

means for supporting each said dam bar bottom edge apart from and above the roof such as to form a flow slot between each said dam bar bottom edge and the roof;

each said spacer bar top edge at its said lower end intersecting one said dam bar top edge;

each said spacer bar top edge at its said upper end intersecting another said dam bar bottom edge.

2. A reusable grid system for cast forming a monolithic roof covering of concrete or other like pourable, curable material atop a sloped roof, the cured roof covering having an exposed finished surface and having the stepped, segmented appearance of a conventional tile roof, said grid system comprising:

a plurality of elongated dam bars placeable parallel and spaced apart horizontally atop the roof;

a plurality of elongated spacer bars releasably and supportively connectable transversly and spaced apart between each two adjacent said horizontally disposed dam bars;

means for supportively spacing the bottom edge of each said dam bar above the roof and forming a flow slot for the pourable concrete;

the finished concrete surface formed by the plurality of planes each defined by the top edge of each particular said horizontally disposed dam bar and the top edges of said transversly disposed spacer bars;

each of said planes generally parallel and offset in step fashion one to another;

the bottom edge of each said transversly disposed spacer bar spaced above the roof so as to form recess lines in the finished surface of the roof covering.

3. A grid system as set forth in claim 1 for use in which the roof has opposing sloped roof portions forming a peak or ridge, said grid system further comprising:

a peak grid means for forming a peak covering of concrete or other like pourable, curable material atop and immediately adjacent either side of the peak of the roof;

the peak cover also having a finished exposed surface having the stepped appearance of conventional tile roof peak.

4. A grid system as set forth in claim 3, wherein said peak grid means include:

a pair of elongated side bars placeable in spaced apart fashion horizontally disposed atop the roof, one on either side of, and parallel to, the peak;

a plurality of angle peak bars releasably and supportively connectable transversly to, and spaced apart between said side bars;

intermittent spacer means for supportively spacing the bottom edge of each said side bars above the roof and forming a flow slot for the pourable concrete;

the top edge of each said side bar having a generally saw-tooth configuration and opposingly matching one to another;

each said angle peak bar having a connected two-part top surface and a connected two-part bottom surface each generally parallel and spaced apart;

each said connected part of said angle peak bar bottom surface forming an angle generally similar to, and spaced above, the roof portions which form the peak;

the finished concrete peak surface formed by the plurality of peak planes each defined by one said side bar top edge saw-tooth portion, one part of said top surface of one peak angle bar, and one part of said bottom surface of an adjacent said peak angle bar;

each of said peak planes on one side of the peak of the roof generally parallel and offset one to another.

5. A grid system as set forth in claim 1, further comprising:

means for concrete encapsulation of the eaves of the roof.

6. A grid system as set forth in claim 1, further comprising:

means for concrete encapsulation of the edge margins of the roof.

7. A grid system as set forth in claim 1, further comprising:

an elongated valley bar placeable along the valley formed by the intersection of adjacent roof sections;

a plurality of tubular dam bar extensions;

each said dam extension mateably adapted to telescope in relation to the end of each said dam said placed atop the adjacent intersecting roof sections forming the valley;

said dam extensions for supportively contacting said valley bar.

8. A grid system as set forth in claim 1, wherein:

at least one of said dam supportive means and the lower edges of a portion of said spacer bars forming a continuous zig-zag channel in the concrete;

the channel being fully against the roof and running transversly from one eave upwardly along the roof to the peak;

the channel adapted to be filled with an elastomeric compound and forming a thermal expansion joint.

9. A grid system as set forth in claim 1, wherein:

said dam bar support means is a concrete dam bar support insert formed to supportively receive the bottom edge of said dam bar;

said insert becoming an integral part of the roof covering.

10. A grid system as set forth in claim 1, wherein:

at least a portion of said spacer bars are movable.

11. A grid system as set forth in claim 10, further comprising:

a recess printer assembly having a plurality of movable spacer bars connected in fixed space relationship one to another to a frame;

each said movable spacer bar simultaneously forming a plurality of recess lines in the finished surface of the roof covering.

12. A grid system as set forth in claim 11, wherein:

the lower edges of each said movable spacer bar are tapered to facilitate their removal from the partially cured roof covering.

* * * * *

UNITED STATES PATENT AND TRADEMARK OFFICE

CERTIFICATE OF CORRECTION

PATENT NO. : 4,696,451

DATED : September 29, 1987

INVENTOR(S) : Peter W. Mansfield

It is certified that error appears in the above-identified patent and that said Letters Patent is hereby corrected as shown below:

Column 8, line 37, "Claim 1" should read -- Claim 2 --.

Column 9, line 1, "Claim 2" should read -- Claim 1 --.

Signed and Sealed this

Fourth Day of October, 1988

*Attest:*

DONALD J. QUIGG

*Attesting Officer*

*Commissioner of Patents and Trademarks*